US006004910A

United States Patent [19]

Bloch et al.

[11] Patent Number: 6,004,910

[45] Date of Patent: Dec. 21, 1999

[54] CRANKCASE LUBRICANT FOR MODERN HEAVY DUTY DIESEL AND GASOLINE FUELED ENGINES

[75] Inventors: Ricardo Alfredo Bloch, Scotch Plains; Arunas T. Lapinas, Pittstown; Edward F. Outten, East Brunswick; Andrew James Dalziel Ritchie, Chatham; Malcolm Waddoups, Westfield, all of N.J.

[73] Assignee: Exxon Chemical Patents Inc., Linden, N.J.

[21] Appl. No.: 08/396,501

[22] Filed: Mar. 7, 1995

Related U.S. Application Data

[63] Continuation-in-part of application No. 08/234,090, Apr. 28, 1994, abandoned.

[51] Int. Cl.[6] ..... C10M 161/00; C10M 145/00

[52] U.S. Cl. ..... 508/294; 508/376; 508/375; 508/380; 508/435

[58] Field of Search ..... 252/32.7 E, 51.5 A, 252/51.5 R; 508/294, 375, 376, 380, 435

[56] References Cited

U.S. PATENT DOCUMENTS

| | | | |
|---|---|---|---|
| 4,904,401 | 2/1990 | Ripple et al. | 252/32.7 E |
| 4,938,880 | 7/1990 | Waddoups et al. | 252/32.7 E |
| 4,941,984 | 7/1990 | Chamberlin et al. | 252/39 |
| 4,957,649 | 9/1990 | Ripple et al. | 252/32.7 E |
| 4,981,602 | 1/1991 | Ripple et al. | 252/32.7 E |
| 5,102,566 | 4/1992 | Fetterman et al. | 252/32.7 E |
| 5,141,657 | 8/1992 | Fetterman et al. | 252/32.7 E |
| 5,202,036 | 4/1993 | Ripple et al. | 252/33.4 |
| 5,320,765 | 6/1994 | Fetterman et al. | 252/32.7 E |

FOREIGN PATENT DOCUMENTS

| | | | |
|---|---|---|---|
| 0 277 729 A1 | 8/1988 | European Pat. Off. | C10M 163/00 |
| 0317354 | 5/1989 | European Pat. Off. . | |
| 317354 | 5/1989 | European Pat. Off. . | |
| 92/18588 | 10/1992 | WIPO . | |

OTHER PUBLICATIONS

Mack Truck Technical Services Standard Test Procedure No. 5GT 57 "Mack T–7: Diesel Engine Oil Viscosity Evaluation", Aug. 31, 1984 ("Mack T–7").

Mack Truck Technical Services Standard Test Procedure No. 5GT 76 "Mack T–8: Diesel Engine Oil Viscosity Evaluation", Oct. 1993 ("Mack T–8").

PCT Search Report dated Sep. 5, 1995 for PCT/US95/05/25.

*Primary Examiner*—Margaret Medley

[57] ABSTRACT

A lubricating oil having an ashless nitrogenous TBN source together with ash containing detergent having a TBN in excess of 100, a source of magnesium, and metal dihydrocarbyl dithiophosphate with predominantly or exclusively secondary hydrocarbyl groups is described. It comprises a major amount of an oil of lubricating viscosity having a sulfated ash content between 0.35 and 2 mass percent and A) a nitrogenous TBN source selected from the group consisting of ashless nitrogen containing dispersants, ashless nitrogen containing dispersant viscosity modifiers, oil soluble aliphatic, oxyalkyl, or arylalkyl amines and mixtures thereof; B) a metal salt of an oil soluble acid having a TBN in excess of 100; C) at least 500 ppm (mass) magnesium; and D) at least one metal dihydrocarbyl dithiophosphate. The nitrogenous TBN source provides at least about 1.5 TBN to the finished lubricant. The metal salt of an oil soluble acid provides at least about 40% of the total TBN of the composition. At least 50 mole per cent of the hydrocarbyl groups on the dithiophosphate are secondary. Overbased magnesium sulfonate may be used as the metal salt of an oil soluble sulfonic acid having a TBN in excess of 100 and the additive providing at least 500 ppm (mass) magnesium. The lubricant may be free of aromatic amines having at least two aromatic groups attached directly to the nitrogen. It may have at least 100 ppm (mass) boron and at least 1000 ppm (mass) phosphorous. The boron-to-nitrogen ratio is at least 0.1.

14 Claims, No Drawings

CRANKCASE LUBRICANT FOR MODERN HEAVY DUTY DIESEL AND GASOLINE FUELED ENGINES

This application is a continuation in part of U.S. Ser. No. 08/234,090 filed Apr. 28, 1994 now abandoned.

FIELD OF THE INVENTION

The present invention relates to crankcase lubricants. More particularly, it relates to universal lubricants which are effective to minimize soot related viscosity increase and thermal oxidation induced viscosity increase while preventing wear and corrosion under a variety of conditions.

BACKGROUND OF THE INVENTION

A crankcase lubricant that performs adequately in one engine at given operating conditions does not necessarily perform adequately when used in a different engine or under different conditions. While theoretically, lubricants could be designed for each possible combination of engine and service condition, such a strategy would be impracticable because many different types of engines exist and the engines are used under different conditions. Accordingly, lubricants that perform well in different types of engines and across a broad spectrum of conditions (e.g. fuel type, operating load, and temperature) are desired. Design of crankcase lubricants is further complicated in that the concentrated mixture of chemicals added to lubricating oil basestocks to impart desirable properties should perform well over a broad range of different quality basestocks. Meeting these requirements has been extremely difficult because the formulations are complicated, tests to ascertain whether a lubricant performs well are extremely expensive and time consuming, and collecting field test data is difficult since variables cannot be controlled sufficiently.

Ever more stringent regulation of vehicle emissions make the task even more challenging. Most recently, in North America the maximum permitted level of sulfur present in over the highway diesel fuel has been lowered to 0.05 wt %. A new API category defined as API CG-4 addresses the performance of heavy duty lubricants with low sulfur fuels. At the same time fuel sulfur levels for off-highway equipment may have a higher level. Furthermore, in some geographical regions such as Latin America, fuel sulfur levels remain high for all applications. Lubricants for use in heavy duty diesel engines therefore need to perform acceptably across a range of sulfur fuel levels.

To meet this need the American Petroleum Institute ("API") issues certification licenses for lubricants that pass a panel of tests designed to verify a lubricant's performance in a variety of engines operated at conditions that have been associated with lubrication problems. In addition to the requirements for API licensing, manufacturers of heavy duty diesel engines periodically have required lubricants to pass additional tests before the lubricant can be approved for use with that manufacturer's engines. Lubricants that meet all the certification requirements of heavy duty diesel engine manufacturers and all the requirements for the highest level of the American Petroleum Institute's oil service classifications for both gasoline fueled engines and heavy duty diesel fueled engines are often referred to as universal oils.

Among the many tests that heavy duty diesel lubricants have been required to pass are the Caterpillar 1G2 and the more recent Caterpillar 1M-PC, 1K, and 1N tests. Acceptability of an oil is based on control of oil consumption and piston deposits (top groove fill, top land heavy carbon, and weighted deposits). Stuck piston rings or distress of the piston, its rings, or its liner will also disqualify an oil. The Caterpillar 1N requires a low sulfur fuel (0.05 wt %) while the 1K uses a fuel with traditional sulfur levels (0.4 wt %).

The Mack T-7 test and its successor the Mack T-8 are part of a panel used to determine acceptability of oils for engines manufactured by Mack Truck Company. The Mack T-7 (the Mack Truck Technical Services Standard Test Procedure N0. 5GT 57 entitled "Mack T-7: Diesel Engine Oil Viscosity Evaluation", dated Aug. 31, 1984) tests soot related viscosity increase in diesel engines.

The Mack T-8 (the Mack Truck Technical Services Standard Test Procedure entitled "Mack T-8: Diesel Engine Oil Viscosity Evaluation", dated October 1993) evolved because the fuel injection timing in some newer engines has been retarded to enable the engines to meet emission requirements. At the same time fuels have been reformulated to have lower sulfur content altering physical and chemical properties of the soot. Some engines designed to run on low sulfur fuel with retarded fuel injection have experienced excessively high soot related viscosity increases, excessively high filter pressure drops, and excessive sludge deposits. The Mack T-8 test runs for 250 hours with an engine operating at 1,800 RPM with an applied load 1010–1031 lb.-ft (1369.4–1397.8 newton-meters). Throughout the test, the soot levels, the differential pressure across the oil filter, and kinematic viscosity of the test fluid are measured. The measured viscosities and soot levels are used to interpolate a viscosity at 3.8 wt % soot level. An oil passes the test if that viscosity differs from the lowest viscosity measured in the test by 11.5 cSt or less. If two tests are run the two results when averaged must be 12.5 cSt or less. If three tests are run the three results when averaged must be less than 13 cSt. An additional requirement includes control of filter pressure differential. The Mack T-8 is much more severe than the Mack T-7 test and requires a higher dispersancy level in the fluid.

Another test required of heavy duty diesel lubricants is the CRC L-38 (ASTM D5119). That test is run on a single cylinder laboratory gasoline engine. It is designed to test a lubricant's ability to prevent corrosion of a bearing made from copper and lead, and to prevent sludge and varnish formation.

Heavy duty diesel engines must also perform satisfactorily in off road conditions. The John Deere Company, a manufacturer of farm equipment, is concerned about high temperature performance of lubricants because oil coolers sometimes become covered with mud. The John Deere 6466A High Temperature Engine Oil Test Procedure (JDQ-78) tests high temperature thermal oxidative oil thickening in a heavy duty diesel engine.

Among the many tests required to meet the API SH classification (and its predecessor the API SG classification) are the Sequence IID (ASTM STP 315h part 1), Sequence IIIE (ASTM D553), and Sequence VE (ASTM D5302). The Seq. IID (ASTM STP 315h part 1) monitors an oil's ability to inhibit rust. It is intended to simulate cold winter conditions for short trip driving when condensation on the valve cover creates a corrosive environment. The Seq. IIIE (ASTM D553) measures high temperature oil thickening, sludge and varnish deposits, and engine wear. The Seq. VE (ASTM D5302) measures the lubricant's ability to prevent deposits and wear encountered during low-temperature, light duty operating conditions. Primary rating factors include measurement of sludge, varnish, and camshaft wear in the engine.

Another factor complicating design of lubricants is the well known problem that an additive, or combination of additives, that improves performance in one respect may make the cost of the lubricant too high or may adversely affect performance in another respect.

Ripple U.S. Pat. No. 5,202,036 describes a formulation designed to pass the Caterpillar 1G2, the Mack T-7, and the CRC L-38 tests. U.S. Pat. No. 5,202,036 uses two parameters to indicate the amount (TBN) and source (metal ratio) of basicity of a given material. Total Base Number, "TBN", is an industry standard used to correlate the basicity of any material to that of potassium hydroxide. The value is reported as mg KOH and is measured according to ASTM D2896. "Metal ratio" is a calculated value that relates the total amount of metal present to number of equivalents of metal required to saturate the anion of the organic acid. If the metal ratio is 1, the amount of metal present is the amount required to saturate the anion of the organic acid. If the metal ratio is greater than 1, metal in excess of that required to saturate the anion is present. The term "overbased" may be used to describe any metal salt of an organic acid having a metal ratio greater than 1 though typically overbased sulfonates will be used at metal ratios in excess of 2.

U.S. Pat. No. 5,202,036, describes a lubricant that has a TBN in the range of 6 to about 15 and has a specifically defined dispersant and an alkali or alkaline earth metal salt of an organic acid having a metal ratio greater than at least about 2 wherein the specifically defined dispersant provides from 0.5 to 1.5 TBN and the metal salt component includes a magnesium salt or salts such that the magnesium salts or salts contribute no more than about 30% of the TBN of the composition. The patent does not address tests required for gasoline fueled engines or the Mack T-8 test.

U.S. Pat. No. 4,941,984 to Chamberlin describes a lubricant intended for use with spark ignited engines fueled by gasoline, alcohol, or mixtures of both. It requires a metal detergent that is either a basic magnesium salt of an organic acid or a basic mixture of alkaline earth metal salts of one or more organic acid wherein at least 50% of the metal is magnesium together with a metal (other than magnesium or calcium) salt of either a substituted succinic acid acylated polyamine or a hydrocarbon substituted aromatic carboxylic acid containing at least one hydroxyl group attached to the aromatic ring. Chamberlin defines "basic" when applied to the magnesium salts as follows: "The basic magnesium salt and other basic alkaline earth metal salts . . . are referred to as basic salts because they contain an excess of magnesium or other alkaline earth metal cation. Generally, the basic or overbased salts will have a metal ratio of about 2 to about 30 or 40." He asserts that his lubricants having high levels of basic (i.e. metal ratio $\geqq 2$) magnesium salts when used in alcohol fueled engines or mixed alcohol/gasoline fueled engines minimize corrosive wear and pre-ignition problems associated with alcohol fueled engines. Chamberlin further asserts that his lubricant can be formulated to qualify for API "SG" classification. The Chamberlin patent is not concerned with the unique problems associated with soot related viscosity increase or piston deposits formed in diesel engines.

Another patent addressing a way to use Group II metal hydrocarbyl sulfonates to achieve high TBN while recognizing that they are deleterious in other respects is EP 277,729 to Rollin. Rollin's formulation includes zinc dithiophosphate having both primary (1°) and secondary (2°) character such that the ratio of primary:secondary is from about 1:1 to about 5:1, a succinimide dispersant; and a TBN in finished oil of at least 8. He states the succinimide is necessary to pass friction tests and the upper limit on the amount of succinimide present does not matter to performance but is determined solely by cost. While Rollin reports a significant number of engine tests, no Mack T-7 results are shown. Nor does he show any test results where the metal salt of a dihydrocarbyl dithiophosphoric acid made from secondary alcohol exceeds the amount made from primary alcohol.

Additional patents relating to the use of zinc dithiophosphates made from specific secondary alcohols and used with specific dispersants are U.S. Pat. Nos. 4,904,401, 4, 957,649, and 4,981,602 all to Ripple.

Despite all the work that has gone before, a need remains for lubricants that perform extremely well in diesel tests that use low sulfur fuel, including the Mack T-8 and the Caterpillar 1N, without compromising performance in the older tests and that deliver the requirements for the highest API classification for lubricants intended to be used in gasoline fueled engines—superior resistance to oxidation, rust, and wear.

SUMMARY OF THE INVENTION

Surprisingly, a lubricating oil having a sulfated ash content between 0.35 and 2 mass percent and having an ashless nitrogenous source of TBN together with ash containing detergent having a TBN in excess of 100, a source of magnesium, and metal dihydrocarbyl dithiophosphate with predominantly or exclusively secondary hydrocarbyl groups gives excellent performance in the Mack T-8, and the Caterpillar 1K and 1N without sacrificing performance in the CRC L-38, the Seq. IID, IIIE, or VE. The finished lubricant has a sulfated ash content between 0.35 and 2 mass per cent and comprises a major amount of an oil of lubricating viscosity to which certain components have been added. The added components are:

A) a nitrogenous TBN source selected from the group consisting of ashless nitrogen containing dispersants, ashless nitrogen containing dispersant viscosity modifiers, oil soluble aliphatic, oxyalkyl, or arylalkyl amines and mixtures thereof;

B) a metal salt of an oil soluble acid having a TBN in excess of 100;

C) a magnesium salt in an amount sufficient to provide at least 500 ppm (mass) magnesium, and D) at least one metal dihydrocarbyl dithiophosphate.

The TBN provided by the nitrogenous source of TBN is at least about 1.5. The metal salt of an oil soluble acid provides at least about 40% of the total TBN of the composition. At least 50 mole per cent of the hydrocarbyl groups on the dithiophosphate are secondary (i.e., at least 50 mole % of the alcohols used to introduce the hydrocarbyl groups into the dithiophosphoric acid precursor to the metal dihydrocarbyl dithiophosphate are secondary). Conveniently at least 60 mole per cent of the hydrocarbyl groups on the dithiophosphate are secondary. Preferably at least 75 mole per cent of the hydrocarbyl groups on the dithiophosphate are secondary. Sulfated ash is the total weight per cent of ash (based on the oil's metal content) and is determined for a given oil by ASTM D874. A common industry standard for determining the amount of magnesium present in fresh oil is the inductively coupled plasma atomic spectroscopy method described in ASTM D4951.

Conveniently the metal salt of an oil soluble acid having a TBN in excess of 100 is a metal salt of an oil soluble sulfonic acid having a TBN in excess of 100. While the additive providing at least 500 ppm magnesium may be a neutral salt, most conveniently, magnesium sulfonate having a TBN in excess of 100 is both the metal salt of an oil soluble acid and the additive providing at least 500 ppm (mass) magnesium.

In other aspects of the invention, the lubricant described above is free of aromatic amines having at least two aromatic groups attached directly to the nitrogen and hetero cyclic nitrogen. Preferably the lubricant both is free of aromatic amines having at least two aromatic groups attached directly to the nitrogen and includes at least 0.0008 mole % hindered phenol antioxidant. Hindered phenol antioxidants are oil soluble phenolic compounds where the hydroxy group is steariclу hindered. In further aspects of the invention the lubricant has additives providing at least 100 ppm (mass) boron and at least 1000 ppm (mass) phosphorous. The boron-to-nitrogen mass ratio is at least 0.1. Common industry standard methods for determining boron and phosphorous levels in lubricating oils are ASTM D5185 and ASTM D4951 respectively.

DETAILED DESCRIPTION

A. Lubricating Oil

The lubricating oil may be selected from any of the synthetic or natural oils used as crankcase lubricating oils for spark-ignited and compression-ignited engines. The lubricating oil base stock conveniently has a viscosity of about 2.5 to about 12 cSt or $mm^2/s$ and preferably about 2.5 to about 9 cSt or $mm^2/s$ at 100° C. Mixtures of synthetic and natural base oils may be used if desired.

B. Nitrogenous Source of TBN

The nitrogenous TBN source is selected from the group consisting of ashless nitrogen containing dispersants, ashless nitrogen containing dispersant viscosity modifiers, oil soluble aliphatic, oxyalkyl, or arylalkyl amines and mixtures thereof.

Nitrogen Containing Ashless Dispersant

In general the nitrogen containing ashless dispersants comprise an oil solubilizing polymeric hydrocarbon backbone derivatized with nitrogen substituents that are capable of associating with polar particles to be dispersed. Typically, the dispersants comprise a nitrogen containing moiety attached to the polymer backbone often via a bridging group. The nitrogen containing ashless dispersant of the present invention may be selected from any of the well known oil soluble salts, amides, imides, amino-esters, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone is typically an olefin polymer, especially polymers comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g. polypropylene or polyisobutylene) or a copolymer of two or more of such olefins (e.g. copolymers of ethylene and an alpha-olefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene).

One preferred class of olefin polymers is polybutenes and specifically polyisobutenes (PIB) or poly-n-butenes, such as may be prepared by polymerization of a $C_4$ refinery stream. Another preferred class of olefin polymers is ethylene alpha-olefin (EAO) copolymers or alpha-olefin homo- and copolymers having in each case a high degree (e.g. >30%) of terminal vinylidene unsaturation. That is, the polymer has the following structure:

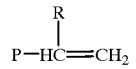

wherein P is the polymer chain and R is a $C_1$–$C_{18}$ alkyl group, typically methyl or ethyl. Preferably the polymers have at least 50% of the polymer chains with terminal vinylidene unsaturation. EAO copolymers of this type preferably contain 1 to 50 wt. % ethylene, and more preferably 5 to 45 wt. % ethylene. Such polymers may contain more than one alpha-olefin and may contain one or more $C_3$ to $C_{22}$ diolefins. Also usable are mixtures of EAO's of low ethylene content with EAO's of high ethylene content. The EAO's may also be mixed or blended with PIB's of various $\overline{M}_n$'s or components derived from these may be mixed or blended. Atactic propylene oligomer typically having $\overline{M}_n$ of from 700 to 500 may also be used, as described in EP-A490454.

Suitable olefin polymers and copolymers may be prepared by cationic polymerization of hydrocarbon feedstreams, usually $C_3$–$C_5$, in the presence of a strong Lewis acid catalyst and a reaction promoter, usually an organoaluminum such as HCl or ethylaluminum dichloride. Tubular or stirred reactors may be used. Such polymerizations and catalysts are described, e.g., in U.S. Pat. Nos. 4,935,576 and 4,952,739. Fixed bed catalyst systems may also be used as in U.S. Pat. No. 4,982,045 and UK-A 2,001,662. Most commonly, polyisobutylene polymers are derived from Raffinate I refinery feedstreams. Conventional Ziegler-Natta polymerization may also be employed to provide olefin polymers suitable for use to prepare dispersants and other additives.

Such preferred polymers may be prepared by polymerizing the appropriate monomers in the presence of a catalyst system comprising at least one metallocene (e.g. a cyclopentadienyl-transition metal compound) and preferably an activator, e.g. an alumoxane compound. The metallocenes may be formed with one, two, or more cyclopentadienyl groups, which are substituted or unsubstituted. The metallocene may also contain a further displaceable ligand, preferably displaced by a cocatalyst—a leaving group—that is usually selected from a wide variety of hydrocarbyl groups and halogens. Optionally there is a bridge between the cyclopentadienyl groups and/or leaving group and/or transition metal, which may comprise one or more of a carbon, germanium, silicon, phosphorus or nitrogen atom-containing radical. The transition metal may be a Group IV, V or VI transition metal. Such polymerizations and catalysts are described, for example, in U.S. Pat. Nos. 4,871,705, 4,937,299, 5,017,714; 5,120,867; 4,665,208; 5,153,157; 5,198,401; 5,241,025; 5,057,475; 5,096,867; 5,055,438; 5,227,440; 5,064,802; U.S. Ser. No. 992,690 (filed Dec. 17, 1992); EP-A-129,368, 520,732, 277,003, 277,004, 420436; WO91/04257, 93/08221 and 93/08199.

The oil soluble polymeric hydrocarbon backbone will usually have number average molecular weight ($\overline{M}_n$) within the range of from 300 to 20,000. The $\overline{M}_n$ of the backbone is preferably within the range of 500 to 10,000, more preferably 700 to 5,000 where the use of the backbone is to prepare a component having the primary function of dispersancy. Hetero polymers such as polyepoxides are also usable to prepare components. Both relatively low molecular weight ($\overline{M}_n$ 500 to 1500) and relatively high molecular weight ($\overline{M}_n$ 1500 to 5,000 or greater) polymers are useful to make dispersants. Particularly useful olefin polymers for use in dispersants have $\overline{M}_n$ within the range of from 1500 to 3000. Where the component is also intended to have a viscosity modification effect it is desirable to use higher molecular weight, typically with $\overline{M}_n$ of from 2,000 to 20,000, and if the component is intended to function primarily as a viscosity modifier then the molecular weight may be even higher with an $\overline{M}_n$ of from 20,000 up to 500,000 or greater. The functionalized olefin polymers used to prepare dispersants preferably have approximately one terminal double bond per polymer chain.

The $\overline{M}_n$ for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The oil soluble polymeric hydrocarbon backbone may be functionalized to incorporate a functional group into the backbone of the polymer, or as pendant groups from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer by oxidation or cleavage of a small portion of the end of the polymer (e.g., as in ozonolysis).

Useful functionalization reactions include: halogenation of the polymer at an olefinic bond and subsequent reaction of the halogenated polymer with an ethylenically unsaturated functional compound; reaction of the polymer with an unsaturated functional compound by the "ene" reaction absent halogenation (an example of the former functionalization is maleation where the polymer is reacted with maleic acid or anhydride); reaction of the polymer with at least one phenol group (this permits derivatization in a Mannich Base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic amine, amino-alcohol, or mixture thereof to form oil soluble salts, amides, imides, amino-esters, and oxazolines. Useful amine compounds include mono- and (preferably) polyamines, most preferably polyalkylene polyamines, of about 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Useful amine compounds for derivatizing functionalized polymers comprise at least one amine and can comprise one or more additional amine or other reactive or polar groups. Where the functional group is a carboxylic acid, carboxylic ester or thiol ester, it reacts with the amine to form an amide. Preferred amines are aliphatic saturated amines. Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. Mixtures of amine compounds may advantageously be used such as those prepared by reaction of alkylene dihalide with ammonia. Useful amines also include polyoxyalkylene polyamines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409.

Dendrimers, star-like amines, and comb-structure amines may also be used. Similarly, one may use the condensed amines of Steckel U.S. Pat. No. 5,053,152. The functionalized polymer of this invention is reacted with the amine compound according to conventional techniques as in EP-A 208,560 and U.S. Pat. No. 5,229,022 using any of a broad range of reaction ratios as described therein.

A preferred group of nitrogen containing ashless dispersants includes those derived from polyisobutylene substituted with succinic anhydride groups and reacted with polyethylene amines (e.g. tetraethylene pentamine, pentaethylene, polyoxypropylene diamine), aminoalcohols such as trismethylolaminomethane, and optionally additional reactants such as alcohols and reactive metals e.g. pentaerythritol, and combinations thereof).

Also useful as nitrogen containing ashless dispersants are dispersants wherein a polyamine is attached directly to the long chain aliphatic hydrocarbon as shown in U.S. Pat. Nos. 3,275,554 and 3,565,804 where a halogen group on a halogenated hydrocarbon is displaced with various alkylene polyamines.

Another class of nitrogen-containing ashless dispersants comprises Mannich base condensation products. Generally, these Mannich condensation products are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a long chain, high molecular weight hydrocarbon (e.g., $\overline{M}_n$ of 1,500 or greater) on the benzene group or may be reacted with a compound containing such a hydrocarbon, for example, polyalkenyl succinic anhydride as shown in U.S. Pat. No. 3,442,808.

Examples of dispersants prepared from polymers prepared from metallocene catalysts and then functionalized, derivatized, or functionalized and derivatized are described in U.S. Pat. Nos. 5,266,223, 5,128,056, 5,200,103, 5,225,092, 5,151,204, U.S. Ser. No. 992,403 (filed Dec. 17, 1992), 992,192 (filed Dec. 17, 1992), 070,572 (filed June 2, 1993); EP-A440506, 513211, 513157.

The functionalizations, derivatizations, and post-treatments described in the following patents may also be adapted to functionalize and/or derivatize the preferred polymers described above: U.S. Pat. Nos. 3,275,554, 3,565,804, 3,442,808, 3,442,808, 3,087,936 and 3,254,025.

The nitrogen containing dispersant can be further post-treated by a variety of conventional post treatments such as boration as generally taught in U.S. Pat. Nos. 3,087,936 and 3,254,025. This is readily accomplished by treating an acyl nitrogen dispersant with a boron compound selected from the class consisting of boron oxide, boron halides, boron acids and esters of boron acids in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g. 0.05 to 0.7 wt. % boron based on the total weight of the borated acyl nitrogen compound. The boron, which appears to be in the product as dehydrated boric acid polymers (primarily $(HBO_2)_3$), is believed to attach to the dispersant imides and diimides as amine salts e.g. the metaborate salt of the diimide.

Boration is readily carried out by adding from about 0.05 to 4, e.g. 1 to 3 wt. % (based on the weight of acyl nitrogen compound) of a boron compound, preferably boric acid, which is usually added as a slurry to the acyl nitrogen compound and heating with stirring at from about 135° C. to 190°, e.g. 140°–170° C., for from 1 to 5 hours followed by nitrogen stripping. Or, the boron treatment can be carried out by adding boric acid to a hot reaction mixture of the dicarboxylic acid material and amine while removing water.

Ashless Nitrogen Containing Dispersant Viscosity Modifiers

Viscosity modifiers (or viscosity index improvers) impart high and low temperature operability to a lubricating oil. Viscosity modifiers that function as dispersants are also known. In general, these dispersant viscosity modifiers are polymers as described below that are functionalized (e.g. inter polymers of ethylene-propylene post grafted with an active monomer such as maleic anhydride) and then derivatized with an alcohol or amine. When the dispersant viscosity modifier is derivatized with a nitrogen containing group, it is a nitrogenous TBN source as contemplated in the present invention. The lubricant may be formulated with or without a conventional viscosity modifier and with or without a dispersant viscosity modifier. When the lubricant contains a dispersant viscosity modifier that contains nitrogen, the TBN contribution of the dispersant viscosity modifier is included in the TBN contribution of the nitrogen containing components of the present invention.

Suitable compounds for use as viscosity modifiers are generally high molecular weight hydrocarbon polymers, including polyesters. Oil soluble viscosity modifying polymers generally have weight average molecular weights of from about 10,000 to 1,000,000, preferably 20,000 to 500,000, as determined by gel permeation chromatography or light scattering methods.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/ isoprene, styrene/butadiene, and isoprene/butadiene, as well as the partially hydrogenated homopolymers of butadiene and isoprene and isoprene/divinylbenzene.

In general, viscosity modifiers that function as dispersant viscosity modifiers are polymers as described above that are functionalized (e.g. inter polymers of ethylene-propylene post grafted with an active monomer such as maleic anhydride) and then derivatized with an alcohol or amine. Description of how to make such dispersant viscosity modifiers are found in U.S. Pat. Nos. 4,089,794, 4,160,739, and 4,137,185. Other dispersant viscosity modifiers are copolymers of ethylene or propylene reacted or grafted with nitrogen compounds such as shown in U.S. Pat. Nos. 4,068,056, 4,068,058, 4,146,489 and 4,149,984.

Oil Soluble Aliphatic, Oxyalkyl, or Arylalkyl Amine

Alkoxylated amines are well known to improve boundary layer lubrication. These compounds may be mono or diamines, for example

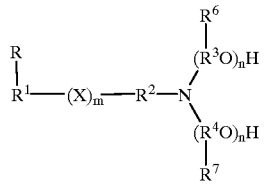

and

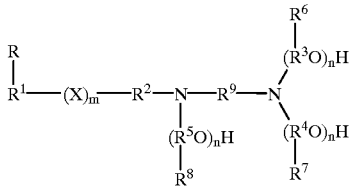

where: R is H or $CH_3$; $R^1$ is a $C_8$–$C_{28}$ saturated or unsaturated, substituted or unsubstituted, aliphatic hydrocarbyl radical, preferably $C_{10}$–$C_{20}$, most preferably $C_{14}$–$C_{18}$; $R^2$ is a straight or branched chain $C_1$–$C_6$ alkylene radical, preferably $C_2$–$C_3$; $R^3$, $R^4$, and $R^5$ are independently the same or different, straight or branched chain $C_2$–$C_5$ alkylene radical, preferably $C_2$–$C_4$; $R^6$, $R^7$, and $R^8$ are independently H or $CH_3$; $R^9$ is a straight or branched chain $C_1$–$C_5$ alkylene radical, preferably $C_2$–$C_3$; X is oxygen or sulfur, preferably oxygen; m is 0 or 1, preferably 1; and n is an integer, independently 1–4, preferably 1.

Conveniently X represents oxygen, R and $R^1$ contain a combined total of 18 carbon atoms, $R^2$ represents a $C_3$ alkylene radical, $R^3$ and $R^4$ represent $C_2$ alkylene radicals, $R^6$ and $R^7$ are hydrogens, m is 1, and each n is 1. Preferred amine compounds contain a combined total of from about 18 to about 30 carbon atoms. These amines may be made according to the process described in U.S. Pat. No. 3,456,012. Another method of preparing an amine where X=oxygen and m=1 is described in U.S. Pat. No. 4,201,684. Still other descriptions of amines where X is oxygen and m is 1 are found in U.S. Pat. Nos. 3,186,946, 4,170,560, 4,231,883, 4,409,000 and 3,711,406.

The amine compounds may be used as such. However, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

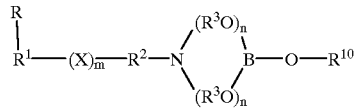

where R, $R^1$, $R^2$, $R^3$, $R^4$, X, m, and n are the same as previously defined and where $R^{10}$ is either hydrogen or an alkyl radical.

Yet another type of amine that may be used is the reaction product of a polyamine and a carboxylic acid or anhydride. These compounds are described in co-pending U.S. Ser. No. 031,937 (filed Mar. 15, 1993). Briefly, the polyamine reactant contains from 2 to 60 total carbon atoms and from 3 to 15 nitrogen atoms with at least one of the nitrogen atoms present in the form of a primary amine group and at least two of the remaining nitrogen atoms present in the form of primary or secondary amine groups. Non-limiting examples of suitable amine compounds include: Polyethylene amines such as diethylene triamine; triethylene tetramine; tetraethylene pentamine; polypropylene amines such as di-(1,2-propylene)triamine, di(1,3-propylene) triamine, and mixtures thereof. Additional suitable amines include polyoxyalkylene polyamines such as polyoxypropylene triamines and polyoxyethylene triamines.

The carboxylic acid or anhydride reactant of the above reaction product is characterized by any of the four formulae shown below:

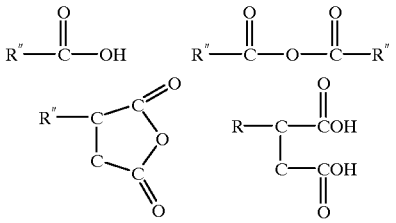

where R" is a straight or branched chain, saturated or unsaturated, aliphatic hydrocarbyl radical containing from 9 to 29 carbon atoms, preferably from 11 to 23. When R" is a branched chain group, no more than 25% of the carbon atoms are in side chain or pendent groups. R" is preferably straight chained. The R" group includes predominantly hydrocarbyl groups as well as pure hydrocarbyl groups. A group is "predominantly hydrocarbyl" if it contains non-hydrocarbyl substituents or non-carbon atoms that do not significantly affect the hydrocarbyl characteristics or properties of the group. For example, a purely hydrocarbyl $C_{20}$ alkyl group and a $C_{20}$ alkyl group substituted with a methoxy substituent are substantially similar in their properties and would be considered hydrocarbyl within the context of this disclosure. Non-limiting examples of substituents that do not significantly alter the hydrocarbyl characteristics or properties of the general nature of the hydrocarbyl groups of the carboxylic acid or anhydride are: ether groups (especially hydrocarbyloxy such as phenoxy, benzyloxy, methoxy, n-isooxy, etc., particularly alkoxy groups of up to ten carbon atoms); oxo groups (e.g., —O— linkages in the main carbon chain); ester groups; sulfonyl groups; and sulfinyl groups.

These types of amines can be formed by reacting, at a temperature from about 120 to 250° C., at least one polyamine and one carboxylic acid or anhydride in proportions of about 2 to 10 molar equivalents of carboxylic acid or anhydride per mole of amine reactant.

C. Metal Salt of an Oil Soluble Acid

This lubricant includes a metal salt of an oil soluble acid having a TBN in excess of 100. The lubricant also requires at least 500 ppm (mass) magnesium. The metal salt of an oil soluble acid provides at least about 40% of the total TBN of the composition. Conveniently the metal salt of an oil soluble acid having a TBN in excess of 100 is a metal salt of an oil soluble sulfonic acid. Most conveniently, a magnesium sulfonate having a TBN in excess of 100 is both the metal salt of an oil soluble acid and the additive providing at least 500 ppm (mass) magnesium.

Magnesium sulfonates having a TBN of greater than 100 are usually produced by heating a mixture of an oil-soluble sulfonate or alkaryl sulfonic acid, with an amount of a magnesium compound in excess of the amount required to completely neutralize of any sulfonic acid present and thereafter forming a dispersed carbonate complex by reacting the excess metal with carbon dioxide. The sulfonic acids are typically obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 30 carbon atoms. For example haloparaffins, olefins obtained by dehydrogenation of paraffins, or polyolefins produced from ethylene or propylene are all suitable. The alkaryl sulfonates usually contain from about 9 to about 70 or more carbon atoms, preferably from about 16 to about 50 carbon atoms per alkyl substituted aromatic moiety.

The oil soluble sulfonates or alkaryl sulfonic acids may be neutralized with magnesium oxides, hydroxides, alkoxides, carbonates, carboxylate, sulfides, hydrosulfides, nitrates, borates and ethers. The amount of magnesium compound is chosen having regard to the desired TBN of the final product but typically ranges from about 100 to 220 wt % (preferably at least 125 wt %).

Various preparations of overbased magnesium alkaryl sulfonates are known, such as EP 312313, 13807, 13808, 15341, 312315, WO 92/20694.

A preferred overbased magnesium sulfonate additive is magnesium alkyl aromatic sulfonate having a TBN ranging from about 300 to about 440 with the magnesium sulfonate content ranging from about 25 to about 32 wt %, based upon the total weight of the additive system dispersed in mineral lubricating oil. The metal ratio of this preferred material is greater than 10 and typically about 15.

Other detergents that may be used in combination with the overbased magnesium salts of sulfonic acids described above include oil-soluble neutral and overbased sulfonates (other than overbased magnesium sulfonates), phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, mixtures of calcium and magnesium, and mixtures of calcium, magnesium or both with sodium. Overbased detergents function both as detergents and acid neutralizers, thereby reducing wear and corrosion and extending engine life. Convenient metal detergents are the neutral and basic calcium sulfonates, neutral and basic calcium phenates and sulfurized phenates, and neutral magnesium sulfonates.

D. Metal Dihydrocarbyl Dithiophosphates

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. The zinc dihydrocarbyl dithiophosphates can be made from mixed DDPA which in turn may be made from mixed alcohols. Alternatively, multiple zinc dihydrocarbyl dithiophosphates can be made and subsequently mixed.

Thus the dithiophosphoric acid containing secondary hydrocarbyl groups used in this invention may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates useful in the present invention are oil soluble salts of dihydrocarbyl dithiophosphoric acids and may be represented by the following formula:

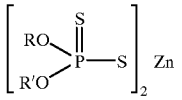

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. At least 50 (mole) % of the alcohols used to introduce hydrocarbyl groups into the dithiophosphoric acids are secondary alcohols. Greater percentages of secondary alcohols are preferred, and in particularly high nitrogen systems may be required. Thus the alcohols used to introduce the hydrocarbyl groups may be 60 or 75 mole per cent secondary. Most preferably the hydrocarbyl groups are more than 90 mole percent secondary.

E. Other Components

Additional additives are typically incorporated into the compositions of the present invention. Examples of such additives are supplemental dispersants, antioxidants, anti-wear agents, friction modifiers, rust inhibitors anti-foaming agents, demulsifiers, and pour point depressants.

Supplemental dispersants, i.e. dispersants that do not contain nitrogen may be used. These nitrogen free dispersants may be esters made by reacting any of the functionalized oil soluble polymeric hydrocarbon backbones described above with hydroxy compounds such as monohydric and polyhydric alcohols or with aromatic compounds such as phenols and naphthols. The polyhydric alcohols are preferred, e.g. ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding nitrogen free ashless dispersants comprise the ether-alcohols and including, for example, the oxy-alkylene, oxy-arylene-. They are exemplified by ether-alcohols having up to about 150 oxy-alkylene radicals in which the alkylene radical contains from 1 to about 8 carbon atoms.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals.

The ester dispersant may be prepared by one of several known methods as illustrated for example in U.S. Pat. No. 3,381,022. The ester dispersants may also be borated, similar to the nitrogen containing dispersants, as described above.

Oxidation inhibitors reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds. Examples of molybdenum compounds include molybdenum salts of inorganic and organic acids (see, for example, U.S. Pat. No. 4,705,641), particularly molybdenum salts of monocarboxylic acids having from 1 to 50, preferably 8 to 18, carbon atoms, for example, molybdenum octoate (2-ethyl hexanoate), naphthenate or stearate; overbased molybdenum-containing complexes as disclosed in EP 404 650A; molybdenum dithiocarbamates and molybdenum dithiophosphates; oil-soluble molybdenum xanthates and thioxanthates as disclosed in U.S. Pat. Nos. 4,995,996 and 4,966,719; and oil-soluble molybdenum- and sulfur-containing complexes.

In one aspect of the invention the lubricant includes at least 0.0008 mole % hindered phenol antioxidant. Generally, hindered phenols are oil soluble phenols substituted at one or both ortho positions. Suitable compounds include monohydric and mononuclear phenols such as 2,6-di-tertiary alkylphenols (e.g. 2,6 di-t-butylphenol, 2,4,6 tri-t-butyl phenol, 2-t-butyl phenol, 4-alkyl, 2,6, t-butyl phenol, 2,6 di-isopropylphenol, and 2,6 dimethyl, 4 t-butyl phenol). Other suitable hindered phenols include polyhydric and polynuclear phenols such as alkylene bridged hindered phenols (4,4 methylenebis(6 tert butyl-o-cresol), 4,4'-methylenebis(2-tert-amyl-o-cresol), and 2,2'-methylenebis (2,6-di-t-butylphenol)). The hindered phenol may be borated or sulfurized. Preferred hindered phenols have good oil solubility and relatively low volatility.

Friction modifiers may be included to improve fuel economy. In addition to the oil soluble aliphatic, oxyalkyl, or arylalkyl amines described above to add nitrogenous TBN, other friction modifiers are known, Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used. When the formulation of the present invention is used, these anti-rust inhibitors are not generally required.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

F. Additives That May Adversely Impact Some Performance Aspects of the Lubricant Several well known classes of additives are frequently used in universal crankcase lubricants. Aromatic amines having at least two aromatic groups attached directly to the nitrogen are often used for their antioxidant properties. While these materials may be used in small amounts, preferred embodiments of the present invention are free of these compounds. These aromatic amines have been found to adversely affect soot induced viscosity increases. They are preferably used in only small amounts, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. These compounds should be minimized or avoided altogether because they have been found to dramatically influence soot related viscosity increase in the Mack T-8. The amount of any such oil soluble aromatic amines having at least two aromatic groups attached directly to one amine nitrogen should preferably not exceed 0.2 wt % active ingredient.

G. Blends

When lubricating compositions contain one or more of the above-mentioned additives, each additive is typically blended into the base oil in an amount which enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Nitrogen containing Ashless Dispersant[1] | 1–8 | 2–7 |
| Overbased Magnesium Sulfonates | 0.2–1 | 0.3–0.8 |
| Supplemental Metal detergents | 0.2–1.5 | 0.35–1 |
| Corrosion Inhibitor | 0–0.2 | 0–0.1 |
| Metal dihydrocarbyl dithiophosphate | 0.5–1.5 | 0.8–1.3 |
| Supplemental anti-oxidant | 0–2 | 0.1–1 |
| Pour Point Depressant | 0.01–1 | 0.1–0.3 |
| Anti-Foaming Agent | 0.0005–0.005 | 0.001–0.004 |
| Supplemental Anti-wear Agents | 0–0.5 | 0–0.2 |
| Friction Modifier | 0–1 | 0–0.5 |
| Viscosity Modifier[2] | 0.01–4 | 0–2 |
| Mineral or Synthetic Base Oil | Balance | Balance |

[1]In multi-graded oils that have dispersant viscosity modifiers, the nitrogen containing ashless dispersant can be used at a much lower treat rate. In this case the dispersant viscosity modifier serves as an additional nitrogenous TBN source. At least one group of investigators (US 5,294,354 to Papke et al.) has reported a formulation with a particular dispersant viscosity modifier where the treat rate of a conventional ashless dispersant is zero. In that case the dispersantviscosity modifier serves as the nitrogenous source of TBN.
[2]Viscosity modifiers are used only in multi-graded oils.

The amount of ashless dispersant is determined in part by the TBN requirement of the present invention and also by requirements to achieve desired dispersancy without unnecessarily increasing the cost of the finished lubricant or introducing performance debits in one or more of the many areas associated with approval of a test fluid. A useful formulation must balance many properties including dispersancy, detergency, antioxidancy, and wear protection. In many instances adding or increasing the level of an additive to improve one of these properties may also impair one or more of the other properties. In this sense the formulator's challenge is to define a zone of operability for each of the parameters while maintaining an acceptable cost.

Controlling TBN contribution from nitrogen containing species has been discovered to influence soot related viscosity increase. A variety of formulation techniques can be used to achieve a contribution to the total TBN of the finished oil of at least 1.5 from nitrogenous sources of TBN, (i.e. nitrogen containing ashless dispersant, nitrogen containing viscosity modifiers, and any oil soluble aliphatic, oxyalkyl or arylalkyl amine present) without substantially increasing the amount of polymer. The TBN of a conventional dispersant can be increased by adjusting the type (amine content, branching, and size) and amount of amine used to aminate the functionalized polymer backbone. Alternatively, the polymer backbone can be functionalized with more functional groups. Conveniently, a conventional high molecular weight dispersant can be blended with a conventional lower molecular weight dispersant to boost the total amount of TBN present relative to dispersant polymer backbone.

When determining the amount and type of nitrogen to be present in the ashless dispersant, consideration should be given to other nitrogen containing sources of TBN in the lubricant. For example, dispersant viscosity modifiers are often derivatized with nitrogen. The contribution of any nitrogenous dispersant viscosity modifiers to the TBN of the lubricant is included when calculating the TBN provided by nitrogenous sources of TBN.

Another nitrogenous TBN source that can increase significantly the TBN contributed by nitrogen containing species are the oil soluble aliphatic, oxyalkyl or arylalkyl amines. Relatively small amounts of these compounds can shift the TBN of the lubricant significantly without otherwise impacting the performance of the dispersants. Surprisingly, this shift in TBN controls soot related viscosity increase.

The total amount of TBN provided by nitrogen containing ashless dispersants, nitrogen containing viscosity modifiers, and oil soluble aliphatic, oxyalkyl or arylalkyl amines should be at least 1.5. Conveniently the TBN provided by the nitrogenous additives is 1.5 to 2.8. Preferably their TBN contribution does not exceed 2.2.

Controlling the amount of TBN contributed by ash containing salts of oil soluble acids is another aspect of the invention. Conveniently overbased magnesium sulfonate is used to contribute at least 40% and preferably 60% of the total TBN of the lubricant. The lubricant should also have at least 500 ppm (mass) of magnesium (contributed either by overbased magnesium sulfonate or by another magnesium detergent). These levels of magnesium give excellent performance in the Seq. IID (ASTM STP 315h part 1).

Use of a metal hydrocarbyl dithiophosphate that is secondary in character is also significant. At least 50 mole % of the alcohols used to introduce hydrocarbyl groups into the dithiophosphoric acids that are subsequently converted to the metal salt should be secondary. Greater percentages of secondary alcohols are preferred, and in particularly high nitrogen systems may be required. Thus the alcohols used to introduce the hydrocarbyl groups may be 60 or 75 mole per cent secondary. Most preferably the hydrocarbyl groups are more than 90 mole percent secondary. Metal dithiophosphates that are secondary in character give better wear control in tests such as the Sequence VE (ASTM D5302) and the GM 6.2L tests. The high levels of nitrogenous TBN required by the present invention to control soot related viscosity increase adversely impacts wear and corrosion performance. This deleterious affect of the high TBN from nitrogenous components is offset by using high levels of metal dithiophosphates that are secondary in character and by using boron to control bearing corrosion.

In a preferred embodiment, the lubricant is free of aromatic amines having at least two aromatic groups attached directly to the nitrogen. These aromatic amines, especially alkylated diphenyl amines, have been found to adversely impact soot related viscosity increase. Formulating the lubricant without these compounds that heretofore have been widely used for their excellent antioxidancy properties permits setting the level of TBN contributed by nitrogenous components closer to the 1.5 minimum thereby minimizing the deleterious effects associated with excessive nitrogen. The lubricant should preferably have less than 0.2 wt % active ingredient of these aromatic amines having at least two aromatic groups attached directly to the nitrogen.

Particularly good control of oil thickening is obtained when the formulation of the present invention both is free of alkyl substituted diphenyl amines and includes a hindered phenol. The TBN from nitrogenous sources controls soot related oil thickening while the metal dithiophosphate and hindered phenol control thermal oxidative oil thickening. Surprisingly a diphenyl amine aggravates soot induced thickening while a hindered phenol (including alkylene bridged bis phenols) does not aggravate soot induced thickening.

Yet another embodiment of the invention requires one or more boron containing additives whereby the lubricant contains at least 100 parts per million (ppm mass) of boron. Conveniently the lubricant contains 180 ppm (mass) boron. Boron helps control corrosion of bearings made from copper and lead. The high levels of nitrogen and magnesium required by the present invention can adversely impact corrosion of these copper/lead bearings. Conveniently, the mass ratio of boron-to-nitrogen is greater than 0.1. Persons skilled in the art of formulating are familiar with various ways to introduce boron. For example, the dispersant or the oil soluble aliphatic, oxyalkyl, or arylalkyl amines can be borated as described above. Alternatively, oil soluble polyols can be borated as described in U.S. Pat. Nos. 4,629,576 to Small and 4,495,088 to Liston.

Still another embodiment requires one or more phosphorus containing additives so that the lubricant contains at least 1000 ppm (mass) of phosphorous. Conveniently, the lubricant contains 1100 ppm (mass) phosphorous. The phosphorous may be present in the metal dithiophosphate. Alternatively, phosphorous can be introduced by using phosphorous containing antioxidants or antiwear components or by phosphorylating the dispersant. These high levels of phosphorous help control corrosion in the CRC L-38. Conveniently, the phosphorous level should not exceed 1500 ppm (mass). Preferably the phosphorous level should not exceed 1200 ppm (mass).

The components may be incorporated into a base oil in any convenient way. Thus, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

Preferably the concentrate is made in accordance with the method described in U.S. Pat. No. 4,938,880. That patent describes making a premix of ashless dispersant and metal detergents that is pre-blended at a temperature of at least about 100° C. Thereafter the pre-mix is cooled to at least 85° C. and the additional components are added. Such a concentrate advantageously comprises

| ADDITIVE | MASS % (Broad) | MASS % (Preferred) |
|---|---|---|
| Nitrogen containing Ashless Dispersant(s)[1] | 20–40 | 30 |
| Overbased Magnesium Sulfonates | 2–6 | 6 |
| Supplemental Metal detergents | 0–6 | 6 |
| Corrosion Inhibitor | 0–0.02 | 0 |
| Metal dithiophosphate | 6–10 | 8 |
| Supplemental anti-oxidant | 0–6 | 6 |
| Anti-Foaming Agent | 0.005–0.02 | 0.011 |
| Supplemental Anti-wear Agents | 0–4 | 0 |
| Friction Modifier | 0–4 | 0 |

[1]In multi-graded oils that have dispersant viscosity modifiers, the nitrogen containing ashless dispersant can be used at a much lower treat rate. In this case the dispersant viscosity modifier serves as an additional nitrogenous TBN source. At least one group of investigators (US 5,294,354 to Papke et al.) has reported a formulation with a particular dispersant viscosity modifier where the treat rate of a conventional ashless dispersant is zero. In that case the dispersant viscosity modifier serves as the nitrogenous source of TBN.

The final formulations may employ from 2 to 15 mass % and preferably 5 to 10 mass %, typically about 7 to 8 mass % of the additive package(s) with the remainder being base oil. A preferred concentrate has A) a nitrogenous TBN source of selected from the group consisting of ashless nitrogen containing dispersants, oil soluble aliphatic, oxyalkyl, or arylalkyl amines and mixtures thereof; B) a metal salt of an oil soluble acid having a TBN in excess of 100; C) a magnesium salt at level providing at least 3100 ppm (mass) magnesium, and D) at least one metal dihydrocarbyl dithiophosphate. The nitrogenous TBN source provides at least about 10 TBN to the concentrate; the metal salt of an oil soluble acid provides at least about 40% of the total TBN of the concentrate and at least 50 mole per cent of the hydrocarbyl groups on the metal dithiophosphate are secondary.

The invention is further described by way of illustration only by reference to the following examples. In the examples, unless otherwise noted, all treat rates of all additives are reported as mass percent active ingredient.

EXAMPLE 1

To a basestock of lubricating viscosity the following components were added to make a 30 grade crankcase lubricant: borated polyisobutenyl-succinimide dispersant (PIB $\overline{M}_n$=2250, PIBSA:Amine=1.5:1, borated), magnesium petroleum sulfonate metal detergent inhibitor (400 TBN), supplemental metal salts of oil soluble organic acids detergent inhibitors, antioxidants, zinc dihydrocarbyl dithiophosphate, amine friction modifier, antifoamant, demulsifier, and pour point depressant. The same additives plus an olefin copolymer viscosity modifier were blended to make an SAE 15W40 multi-graded crankcase lubricant. Both finished lubricants had:

| | |
|---|---|
| Boron | 200 ppm |
| Magnesium | 1120 ppm |
| Phosphorous | 1120 ppm |
| TBN | 7.95 |
| TBN-from nitrogenous sources | 1.8 |
| TBN-from magnesium sulfonate | 4.9 |
| % TBN from magnesium sulfonate | 61.6 |
| Mole % secondary hydrocarbyl groups in ZDDP | 90.9 |
| Boron-to-Nitrogen (mass ratio) 0.2 | |

Both lubricants were tested yielding the results shown in Table I. The lubricants provide excellent rust protection, soot handling control, diesel deposit control, bearing corrosion protection, and wear protection, while maintaining performance needs in other key areas such as oxidation control (Seq. IIIE), and protection from sludge and varnish in gasoline engines (Seq. VE).

TABLE I

| SAE Viscosity Grade | LIMITS[1] | 15W-40 | SAE 30 |
|---|---|---|---|
| CRC L-38 (ASTM D5119)[2] | | | |
| Bearing weight loss | 40 max | 31.3 | |
| Seq. IID (ASTM STP 315 h part 1)[2] | | | |
| Average rust merits | 8.5 min | 8.91 | |
| Stuck lifters | 0 max | 0 | |
| Sequence IIIE (ASTM D553)[2] | | | |
| Viscosity increase at 64 hrs, %[3] | 375 max | 59 | |
| Hrs to 375% viscosity increase | 64 min | 74.0 | |
| Average engine sludge | 9.2 min | 9.57 | |
| Piston skirt varnish | 8.9 min | 9.35 | |
| Oil ring land deposits | 3.5 min | 7.14 | |
| Cam + lifter wear μg - Avg | 30 max | | 5.7 |
| μg - Max | 64 max | | 8.0 |
| Oil consumption. liters | 5.1 max | | 2.58 |
| Stuck rings | 0 max | | 0 |
| Seq. VE (ASTM D5302)[2] | | | |
| Average sludge | 9.0 min | | 9.27 |
| Rocker arm cover sludge | 7.5 min | | 9.09 |
| Average varnish | 5.0 min | | 6.45 |
| Piston skirt varnish | 6.5 min | | 7.37 |
| Oil screen sludge, % | 20 max | | 1 |
| Cam wear mils - Avg | 5.0 max | | 1.28 |
| mils - max | 15.0 max | | 1.3 |
| Hot stuck rings | 0 max | | 0 |
| Mack T-8[4] | | | |
| Viscosity increase at 3.8 soot, wt % | 11.5 max | 5.2 | 7.6 |
| Filter pressure increase, psi | 20 max | 10.8 | 16.5 |
| Oil consumption g/Kw-h | 0.304 max | 0.16 | 0.21 |
| Caterpillar 1N[4] | | | |
| Top groove fill, % | 20 max | 8 | 12 |
| Weighted demerits | 286.2 max | 264.7 | 224.9 |
| Top land heavy carbon | 3 max | 0 | 0 |
| Oil consumption, g/Kw-h | 0.5 max | 0.18 | 0.26 |
| GM 6.2 L[4] | | | |
| Roller pin wear, mils | 0.45 max | 0.23 | 0.08 |
| Caterpillar 1K[5] | | | |
| Top groove fill | 24 max | 9 | |
| Weighted demerits | 332 max | 237.8 | |
| Top land heavy carbon | 4 max | 0 | |
| Oil consumption, | 0.5 max | 0.19 | |
| Mack T-6[5] | | | |
| Merit rating | 90 min | 135.5 | 105.5 |
| Mack T-7[5] | | | |
| Visc. Increase Rate, % (100 hr–150 hr) | 0.04 max | | 0.015 |

[1]One test limit; two and three test limits also exist.
[2]API SH limits.
[3]The API CG-4 limit is maximum 67.5 hours to a 375% viscosity increase.
[4]API CG-4 limits
[5]API CF-4 limits

EXAMPLE 2

To test the effect of varying TBN contribution from nitrogenous sources a crankcase lubricant was blended by adding to a basestock the following components: borated polyisobutenyl-succinimide dispersant, magnesium petroleum sulfonate metal detergent inhibitor (400 TBN), supplemental metal salts of oil soluble organic acids detergent inhibitors, antifoamant, demulsifier, olefin copolymer viscosity modifier and pour point depressant. To that reference lubricant various additional sources of nitrogenous TBN and zinc dihydrocarbyl dithiophosphates as detailed in Table II were added. Mack T-8 tests were run on each lubricant.

TABLE II

| Example | 2A | 2B | 2C | 2D |
|---|---|---|---|---|
| ZDDP (100 mole % 2° hydrocarbyl groups) | 1.22 | 1.22 | | 1.22 |
| ZDDP (92 mole % 2° hydrocarbyl groups) | — | — | 1.05 | — |
| Amine friction modifier | — | 0.6 | — | — |
| Reaction adduct of polyisobutenyl succinic anhydride and dimethylaminopropylamine | — | — | 1.1 | — |
| Polyisobutenyl-succinimide (unborated) | — | — | — | 2 |
| Boron, ppm. | 180 | 180 | 180 | 180 |
| Magnesium, ppm | 920 | 920 | 920 | 920 |
| Phosphorous, ppm | 1120 | 1120 | 1120 | 1120 |
| Total TBN, mg KOH | 6.26 | 7.16 | 7.3 | 8.1 |
| TBN from Nitrogenous components, mg KOH | 1.44 | 2.34 | 2.46 | 3.28 |
| % TBN from Magnesium sulfonate, mg KOH | 70.2 | 61 | 34 | 40.5 |
| Mole % 2° hydrocarbyl groups in ZDDP | 100 | 100 | 90.9 | 100 |
| Boron-to-Nitrogen (mass ratio) | 0.2 | 0.16 | 0.16 | 0.11 |
| Mack T-8 test results | | | | |
| Viscosity Increase at 3.8 wt % soot, cSt (11.5 max) | 17.3 | 9.4 | 11 | 7.2 |
| Filter pressure Delta P, psi (20 max) | 13.0 | 8.0 | 9.0 | 7.4 |
| Soot at EOT, mass % | 3.8 | 3.9 | 4.2 | 4.6 |

EXAMPLE 3

Alkylated diphenyl amines have been found to increase the soot induced viscosity increase experienced by a test fluid in the Mack T-8. The lubricant should contain aromatic amines having two aromatic groups attached directly to an amine nitrogen only at very low amounts (i.e. at a treat rate not exceeding 0.2 wt % active ingredient) and preferably not at all. To demonstrate this effect two crankcase lubricants were blended by adding to a basestock the following components: borated polyisobutenyl-succinimide dispersant, magnesium petroleum sulfonate metal detergent inhibitor (400 TBN), a supplemental metal salt of oil soluble organic acid detergent inhibitor, zinc dihydrocarbyl dithiophosphate, antifoamant, demulsifier, olefin copolymer viscosity modifier and pour point depressant. The two oils, which differed only in that one contained mixed nonyl diphenyl amines, were tested in the Mack T-8. The amounts of alkylated diphenyl amine and test results are shown in Table III:

TABLE III

| Example | 3A | 3B |
|---|---|---|
| Mixed nonyl diphenyl amine | 0 | 0.4 |
| Mack T-8 | | |
| Viscosity increase at 3.8 wt % soot, wt % | 11 | 39.2 |
| Filter pressure drop, psi | 13.5 | 12 |
| End of test soot, wt % | 5.8 | 4.1 |

EXAMPLE 4

Nitrogen functionalized high molecular weight viscosity index improvers are also able to reduce the soot induced viscosity increases as shown by the following tests run on a lubricant having borated polyisobutenyl-succinimide dispersant, magnesium petroleum sulfonate metal detergent inhibitor (400 TBN), a supplemental metal salt of oil soluble organic acid detergent inhibitor, two zinc dihydrocarbyl dithiophosphates, mixed nonyl diphenyl amine, a thiodiazole corrosion inhibitor, antioxidant, antifoamant, demulsifier and pour point depressant. In one lubricant the viscosity modifier was a conventional olefin copolymer viscosity modifier with a small amount of nitrogen functionalized polymethylmethacrylate; in the other the only viscosity modifier was the nitrogen functionalized polymethylmethacrylate. As can be seen from the Mack T-8 results shown in Table IV the dispersant viscosity modifier reduced the soot induced viscosity increase.

TABLE IV

| Example | 4A | 4B |
|---|---|---|
| Additive package A | 12.25 | 12.25 |
| Ethylene copolymer | 0.42 | — |
| N functionalized PMA | 0.1 | 0.8 |
| Total TBN mg KOH | 8.8 | 8.9 |
| TBN-from nitrogenous sources* | 1.2 | 1.3 |
| Mack T-8 Results | | |
| Viscosity Increase at 3.8 wt % soot, wt % | 40 | 23 |
| Filter pressure Delta P at 200 hr, psi | 11.5 | 9 |
| Soot at 200 hours, wt % | 3.8 | 4.5 |

*The TBN content of any diphenylamine present is excluded.

EXAMPLE 5

A minimum level of a magnesium which may be provided by an overbased magnesium sulfonate is required. Two crankcase lubricants were blended by adding to a basestock a borated polyisobutenyl-succinimide dispersant, magnesium petroleum sulfonate metal detergent inhibitor (400 TBN), supplemental metal salts of oil soluble organic acids detergent inhibitors, antioxidant, zinc dihydrocarbyl dithiophosphate ZDDP (90.9 mole % 2° hydrocarbyl groups), antifoamant, demulsifier, olefin copolymer viscosity modifier and pour point depressant. The two lubricants which differed from each other only in the amount of overbased magnesium petroleum sulfonate metal detergent inhibitor (400 TBN) they contained, were tested in the Seq. IID (ASTM STP 315h part 1). Particulars of the formulations and test results are shown in Table V.

TABLE V

| Example | 5A | 5B |
|---|---|---|
| Magnesium sulfonate (400 TBN) | 0.43 | 0.26 |
| Boron, ppm (mass) | 190 | 190 |
| Magnesium, ppm (mass) | 690 | 420 |
| Phosphorus, ppm (mass) | 1120 | 1120 |
| Zinc, ppm (mass) | 1230 | 1230 |
| Total TBN | 6.53 | 5.3 |
| TBN-from nitrogenous components | 1.55 | 1.55 |
| TBN from Magnesium sulfonate | 3 | 1.8 |
| % TBN from Magnesium sulfonate | 46 | 34 |
| Boron to nitrogen mass ratio | 0.22 | 0.22 |
| Average Rust (Pass = 8.5 min)[1] | 8.63 | 6.67 |

[1]API SH limit

EXAMPLE 6

Boron controls the attack of nitrogen on bearings made from copper and lead. It is particularly necessary in systems with high levels of nitrogenous TBN. Two 5W-30 crankcase lubricants were blended by adding to a basestock a polyisobutenyl-succinimide dispersant, magnesium petroleum sulfonate metal detergent inhibitor (400 TBN), supplemental metal salts of oil soluble organic acids detergent inhibitors, antioxidants, zinc dihydrocarbyl dithiophosphate (90.9 mole % 2° hydrocarbyl groups), antifoamant, demulsifier, friction modifiers, olefin copolymer viscosity modifier and pour point depressant. The two lubricants which differed from each other only in that one had a borated dispersant and the other had an unborated dispersant were tested in the CRC L-38 (ASTM D5119).

TABLE VI

| Example | 6A | 6B |
|---|---|---|
| Boron, ppm (mass) | 190 | 0 |
| Magnesium, ppm (mass) | 1190 | 1190 |
| Phosphorus, ppm (mass) | 1130 | 1130 |
| Total TBN | 8.07 | 8.07 |
| TBN-from nitrogenous sources[1] | 2.0 | 2.0 |
| TBN from Magnesium sulfonate | 5.2 | 5.2 |
| % TBN from Magnesium sulfonate | 64.4 | 64.4 |
| Mole % 2° hydrocarbyl groups in ZDDP | 90.9 | 90.9 |
| Boron-to-Nitrogen (mass ratio)[1] | 0.15 | 0 |
| CRC L-38 Bearing weight loss, mg (40 max)[2] | 46.6 | 217.9 |

[1]The TBN and nitrogen content of any diphenyl amine present are excluded from the TBN-from nitrogenous sources and Boron-to-Nitrogen (mass ratio) respectively.
[2]API SH limit.

EXAMPLE 7

A further example shows the need to set a Boron-to-Nitrogen mass ratio of the final formulation at or above 0.1. Two crankcase lubricants were blended by adding to a basestock a mixture of polyisobutenyl-succinimide dispersants, magnesium petroleum sulfonate metal detergent inhibitor (400 TBN), supplemental metal salts of oil soluble organic acids detergent inhibitors, antioxidants, zinc dihydrocarbyl dithiophosphate (90.9 mole % 2° hydrocarbyl groups), antifoamant, demulsifier, friction modifiers, olefin copolymer viscosity modifier and pour point depressant. The two lubricants which differed from each other only in the mixtures of dispersants used and the amount of zinc dihydrocarbyl dithiophosphate were tested in the CRC L-38 (ASTM D5119). The adjustments in the dispersant mixtures influenced the amount and $\overline{M}_n$ of the polyisobutenyl substituent on the succinic group and the amounts of nitrogen and boron. Details of the formulations and test results are shown in Table VII.

TABLE VII

| Example | 7A | 7B |
|---|---|---|
| Polyisobutenylsuccinimide dispersant (PIB $\overline{M}n$ = 2250, PIBSA:Amine = 1.5:1, borated) | 3.1 | 2.1 |
| Polyisobutenylsuccinimide dispersant (PIB $\overline{M}n$ = 950, PIBSA:Amine = 2.1:1, unborated) | 1.05 | 2.1 |
| ZDDP | 1.12 | 1.06 |
| Boron, ppm (mass) | 150 | 100 |
| Phosphorus, ppm (mass) | 1200 | 1120 |
| Zinc, ppm (mass) | 1320 | 1230 |
| Total TBN | 8.4 | 8.96 |
| TBN-from nitrogenous sources | 2.08 | 2.69 |
| TBN from Magnesium sulfonate | 4.0 | 4.0 |
| % TBN from Magnesium sulfonate | 47.6 | 30. |
| Mole % 2° hydrocarbyl groups in ZDDP | 90.9 | 90.9 |
| Boron-to-Nitrogen (mass ratio) | 0.13 | 0.07 |
| CRC-L38 Bearing weight loss (mg) (40 max)[1] | 29.4 | 52.9 |

[1]API SH limit

EXAMPLE 8

The need to use a ZDDP or mixtures of ZDDPs having predominantly or exclusively secondary hydrocarbyl groups is illustrated by the data below from an experimental cylinder head rig. Three crankcase lubricants were prepared by adding to a basestock a polyisobutenyl-succinimide dispersant, magnesium petroleum sulfonate metal detergent inhibitor (400 TBN), antioxidant, one or two zinc dihydrocarbyl dithiophosphates, antifoamant, demulsifier, olefin copolymer viscosity modifier and pour point depressant. The rig used is a cam and tappet rig developed and supplied by the Motor Industries Research Association of Nuneaton, Warks UK. It comprises a 30 mm circular cam of induction heated chilled cast iron running on a 12.5 mm eccentric shaft against a EN 32b tappet which has a 2 m radius of curvature on the contacting face. Load is applied via variable resistance springs. Lubrication is by high pressure jet from a heated reservoir. Flow rate is adjusted to 150 ml/min. Wear tests are carried out according to the following protocol. Speed 1500 rpm., duration, 30 min at 20 kgm applied load (running in time), followed by 60 min at 60 kgm applied load. Lubricant performance is measured in terms of follower wear. This is determined by the reduction in dimensions of a Vickers hardness indentation made in the center of the follower prior to test. All test components are standard and supplied by the original equipment manufacturer. Tests carried out on the experimental oils described above were performed at an oil temperature of 65° C.. These results are shown in Table VIII. The three lubricants which differed in the mix of hydrocarbyl groups present on the ZDDPs gave very different wear performance. The lubricants wherein the hydrocarbyl groups present on the ZDDPs were exclusively or predominantly secondary gave superior wear protection.

TABLE VIII

| Example | 8A | 8B | 8C |
|---|---|---|---|
| ZDDP (90.9 mole % 2° hydrocarbyl groups) | 1.05 | 0.56 | 0 |
| ZDDP (100 mole % 1° hydrocarbyl) | 0 | 0.67 | 1.44 |
| Boron, ppm (mass) | 190 | 190 | 190 |
| Total TBN | 6.53 | 6.53 | 6.53 |
| TBN-from nitrogenous sources | 1.51 | 1.51 | 1.51 |
| Boron-to-Nitrogen (mass ratio) | 0.23 | 0.23 | 0.23 |
| % TBN from magnesium sulfonate | 61.2 | 61.2 | 61.2 |
| Mole % 2° hydrocarbyl groups on ZDDP | 90.9 | 48.1 | 0 |
| WEAR, mils | 4.3 | 6 | 6 |

EXAMPLE 9

The use of a zinc dihydrocarbyl dithiophosphate containing predominantly secondary hydrocarbyl groups is necessary to achieve satisfactory wear performance in the Seq. VE (ASTM D5302). Systems containing high levels of nitrogen can impair the antiwear protection of fluid. To demonstrate the value of using ZDDP containing predominantly secondary hydrocarbyl groups, three crankcase lubricants were prepared by adding to a basestock a polyisobutenylsuccinimide dispersant, magnesium petroleum sulfonate metal detergent inhibitor (400 TBN), antioxidants, one or two zinc dihydrocarbyl dithiophosphates, antifoamant, demulsifier, olefin copolymer viscosity modifier and pour point depressant. The three lubricants which differed in the amount of TBN from nitrogenous components (one had an amine friction modifier) and the mole percent of secondary hydrocarbyl groups on the ZDDP were tested in the Seq. VE.

TABLE IX

| Example | 9A | 9B | 9C |
|---|---|---|---|
| ZDDP (predominantly 2° hydrocarbyl groups) | 0.48 | 1.05 | 1.05 |
| ZDDP (all 1° hydrocarbyl groups) | 0.56 | 0 | 0 |
| Amine friction modifier | 0 | 0 | 0.5 |
| Boron | 150 | 150 | 150 |
| Magnesium | 1180 | 1180 | 1180 |
| Phosphorus | 1120 | 1120 | 1120 |
| Zinc | 1230 | 1230 | 1230 |
| Total TBN | 6.7 | 6.76 | 7.51 |
| TBN from nitrogenous components | 1.13 | 1.13 | 1.87 |
| TBN from Magnesium sulfonate | 5.1 | 5.1 | 5.1 |
| % TBN from Magnesium sulfonate | 76 | 76 | 68 |
| Mole % 2° hydrocarbyl groups on ZDDP | 50 | 90.9 | 90.9 |
| Boron-to-Nitrogen (mass ratio) | 0.2 | 0.2 | 0.16 |
| Seq. VE (ASTM D5302)average wear, mils[1] | 5.22 | 2.65 | 4.52 |

[1]The API SH limit is average wear <5 mils.

To control wear in the Seq. VE (ASTM D5302) test when using high nitrogen systems it is thus necessary to use a ZDDP or mixtures of ZDDPs having predominantly or exclusively secondary hydrocarbyl groups

EXAMPLE 10

While amines having at least two aromatic groups attached directly to the nitrogen must be avoided because of their adverse impact on soot induced oil thickening, antioxidants are required to control thermal oxidation induced oil thickening. Historically, phosphorous free antioxidants have been used so that the amount of phosphorous provided by the zinc dihydrocarbyl dithiophosphate may be kept to acceptable levels, often below 1500 ppm and preferably below 1200 ppm (mass) in the finished lubricant. Aromatic amines having at least two aromatic groups attached directly to the nitrogen, e.g. alkyl substituted diphenyl amines, have been particularly preferred phosphorous free antioxidants. Surprisingly, hindered phenol antioxidants do not have an adverse effect on soot induced oil thickening and can be substituted for diphenyl amines. The benefit of the present invention with its high levels of nitrogenous TBN and hindered phenols is evident in the John Deere 6466A test which combines both thermal oxidation and soot induced viscosity increases.

To demonstrate efficacy of hindered phenols in the Seq IIIE test two lubricants containing differing only in the amounts of 4,4'-methylene-bis-2,6, di tert-butyl phenol were run in the Seq IIIE test. Viscosity increase results are reported in Table X.

TABLE X

| Example | | 10A | 10B |
|---|---|---|---|
| hindered phenol | moles/100 gm oil | 0.0055 | 0.011 |
| hrs to 375% viscosity increase | (67.5 min)[1] | 63.9 | 72.6 |

[1]API CG-4 limit

To demonstrate that hindered phenols do not adversely affect the Mack T-8 test, two lubricant that were identical in all respects expect that one had a hindered phenol antioxidant were tested in the Mack T-8 Test. The lubricant with hindered phenol yielded a test result that, within the precision of the test, is indistinguishable from the lubricant that did not have the hindered phenol (24.84 versus 22.57 viscosity increase at 3.8 wt % soot).

The surprising effect of the present invention to control both soot and thermal-oxidation induced oil thickening is found in the John Deere JD6466A test. That tests uses a six cylinder, 226 horsepower engine to evaluate a lubricant's ability to control oxidation, wear, deposits and oil consumption. In Table X(a) a SAE 1 5W40 lubricant formulated in accordance with the present invention is compared to a conventional SAE 15W40 formulation having mixed nonyl diphenylamines and no hindered phenol. In all respects the lubricant of the present invention demonstrates excellent performance, while the conventional lubricant is unable to meet the end of test viscosity target.

TABLES X(a)

| Parameter | Target | Conventional Lubricant 300 hour | Example 10C 300 hour |
|---|---|---|---|
| Magnesium, ppm | | 660 | 1250 |
| Boron, ppm | | 170 | 200 |
| Phosphorous, ppm | | 1210 | 1190 |
| TBN of lubricant | | 10.1 | 8.6 |
| TBN from nitrogenous sources | | 1.36 | 1.76 |
| TBN from magnesium sulfonate | | 7.37 | 5.5 |
| Mole % secondary hydrocarbyl groups in ZDDP | | 47.8 | 90.9 |
| Antioxidant | | $C_9$ diphenyl amine | Hindered phenol[1] |

TABLES X(a)-continued

| | Target | Conventional Lubricant 300 hour | Example 10C 300 hour |
|---|---|---|---|
| Test Parameters | | | |
| Oil consumption, gm/Kw-hr | <0.300 | 0.1585 | 0.1098 |
| Viscosity increase, % | <50 | 113 | 2.8 |
| Top ring wear, μm | <10.0 | 6.9 | 5.7 |
| Second ring, μm | <8.0 | 6.2 | 3.0 |
| Cylinder liner wear, μm | <5.0 | 1.9 | 1.5 |
| Cam & follower wear, μm | <60.0 | 35 | 20.2 |
| Upper piston deposits | <100 | 126 | 107 |
| Lower piston deposits | <2.0 | 19.5 | 2.9 |
| Crownland heavy carbon, % | 0 | 3.3 | 0 |

[1]$C_7OH$—$C_9OH$ ester of β-(3,5-di-t-butyl-4-hydroxyphenyl-propionic acid)

What is claimed is:

1. A crankcase lubricant having a sulfated ash content between 0.35 and 2 mass percent comprising a major amount of an oil of lubricating viscosity to which the following components have been added:

A) a nitrogenous TBN source selected from the group consisting of ashless nitrogen containing dispersants, ashless nitrogen containing dispersant viscosity modifiers, oil soluble aliphatic, oxyalkyl, or arylalkyl amines and mixtures thereof wherein said nitrogen containing dispersant is selected from the group consisting of oil soluble salts, amides, imides, amino-esters, and oxazolines of long chain hydrocarbon substituted mono and dicarboxylic acids or their anhydrides; long chain aliphatic hydrocarbons having a polyamine attached directly thereto; and Mannich condensation products formed by condensing a long chain substituted phenol with formaldehyde and polyalkylene polyamine wherein the long chain hydrocarbon has an $\overline{M}_n$ of 300 to 20,000;

B) a metal salt of an oil soluble acid having a TBN in excess of 100;

C) a magnesium salt of an oil soluble organic acid in an amount providing at least 500 ppm (mass) magnesium, and D) at least one metal dihydrocarbyl dithiophosphate wherein the nitrogenous TBN source provides at least about 1.5 TBN to the lubricant; the metal salt of an oil soluble acid provides at least about 40% of the total TBN of the lubricant; and at least 50 mole percent of the hydrocarbyl groups on the metal dithiophosphate are secondary.

2. The lubricant of claim 1 wherein the metal salt of an oil soluble acid having a TBN in excess of 100 is a metal salt of an oil soluble sulfonic acid.

3. The lubricant of claim 2 wherein the metal salt of an oil soluble sulfonic acid is a magnesium salt that also provides the required 500 ppm (mass) magnesium.

4. The lubricant of claim 1 further characterized by having no more than 0.2 mass percent active ingredient of aromatic amines having at least two aromatic groups attached directly to the nitrogen.

5. The lubricant of claim 1 further comprising a boron containing additive in an amount that provides at least 100 ppm (mass) boron.

6. The lubricant of claim 5 wherein the boron-to-nitrogen mass ratio is larger than 0.1.

7. The lubricant of claim 1 wherein the lubricant has at least 1000 ppm mass phosphorous.

8. A concentrate comprising:

A) A nitrogenous TBN source of selected from the group consisting of ashless nitrogen containing dispersants, oil soluble aliphatic, oxyalkyl, or arylalkyl amines and mixtures thereof wherein said nitrogen containing dispersant is selected from the group consisting of oil soluble salts, amides, imides, amino-esters, and oxazolines of long chain hydrocarbon substituted mono and dicarboxylic acids or their anhydrides; long chain aliphatic hydrocarbons having a polyamine attached directly thereto; and Mannich condensation products formed by condensing a long chain substituted phenol with formaldehyde and polyalkylene polyamine wherein the long chain hydrocarbon has an $\overline{M}_n$ of 300 to 20,000;

B) a metal salt of an oil soluble acid having a TBN in excess of 100;

C) a magnesium salt in an amount that provides at least 3100 ppm (mass) magnesium, and D) at least one metal dihydrocarbyl dithiophosphate wherein the nitrogenous TBN source provides at least about 10 TBN to the concentrate; the metal salt of an oil soluble acid provides at least about 40% of the total TBN of the concentrate and at least 50 mole per cent of the hydrocarbyl groups on the metal dithiophosphate are secondary.

9. A crankcase lubricant having a sulfated ash content between 0.35 and 2 mass per cent comprising a major amount of an oil of lubricating viscosity to which the following components have been added:

A) a nitrogenous TBN source selected from the group consisting of ashless nitrogen containing dispersants, ashless nitrogen containing dispersant viscosity modifiers, oil soluble aliphatic, oxyalkyl, or arylalkyl amines and mixtures thereof wherein said nitrogen containing dispersant is selected from the group consisting of oil soluble salts, amides, imides, amino-esters, and oxazolines of long chain hydrocarbon substituted mono and dicarboxylic acids or their anhydrides; long chain aliphatic hydrocarbons having a polyamine attached directly thereto; and Mannich condensation products formed by condensing a long chain substituted phenol with formaldehyde and polyalkylene polyamine wherein the long chain hydrocarbon has an $\overline{M}_n$ of 300 to 20,000;

B) a metal salt of an oil soluble acid having a TBN in excess of 100;

C) a magnesium salt in an amount providing at least 500 ppm (mass) magnesium;

D) at least one metal dihydrocarbyl dithiophosphate, and

E) at least 0.0008 mole % oil soluble hindered phenol antioxidant wherein the nitrogenous TBN source provides at least about 1.5 TBN to the lubricant; the metal salt of an oil soluble acid provides at least about 40% of the total TBN of the composition, at least 50 mole per cent of the hydrocarbyl groups on the metal dithiophosphate are secondary and the lubricant is free of aromatic amines having at least two aromatic groups attached directly to the nitrogen.

10. The crankcase lubricant of claims 1, 3, 5, 7 or 9 wherein at least 75 mole per cent of the hydrocarbyl groups on the metal dithiophosphate are secondary.

11. A crankcase lubricant having a sulfated ash content between 0.35 and 2 mass per cent comprising a major amount of an oil of lubricating viscosity to which the following components have been added:

A) a nitrogenous TBN source selected from the group consisting of ashless nitrogen containing dispersants, ashless nitrogen containing dispersant viscosity modifiers, oil soluble aliphatic, oxyalkyl, or arylalkyl amines and mixtures thereof wherein said nitrogen containing dispersant is selected from the group consisting of oil soluble salts, amides, imides, amino-esters, and oxazolines of long chain hydrocarbon substituted mono and dicarboxylic acids or their anhydrides; long chain aliphatic hydrocarbons having a polyamine attached directly thereto; and Mannich condensation products formed by condensing a long chain substituted phenol with formaldehyde and polyalkylene polyamine wherein the long chain hydrocarbon has an $\overline{M}_n$ of 300 to 20,000;

B) a metal salt of an oil soluble acid having a TBN in excess of 100;

C) a magnesium salt in an amount providing at least 500 ppm (mass) magnesium;

D) at least one metal dihydrocarbyl dithiophosphate

E) at least 0.0003 mole % oil soluble hindered phenol antioxidant, and

F) a boron containing additive in an amount that provides at least 100 ppm (mass) boron wherein the nitrogenous TBN source provides at least about 1.5 TBN to the lubricant; the metal salt of an oil soluble acid provides at least about 40% of the total TBN of the composition, at least 75 mole per cent of the hydrocarbyl groups on the metal dithiophosphate are secondary, the lubricant is free of aromatic amines having at least two aromatic groups attached directly to the nitrogen, the lubricant contains at least 1000 ppm (mass) phosphorous, and the boron-to-nitrogen ratio is larger than 0.1.

12. The lubricant of claim 1 wherein said long chain hydrocarbon has an $\overline{M}_n$ of from about 1500 to about 5,000.

13. The lubricant of claim 1 wherein said long chain hydrocarbon has an $\overline{M}_n$ of from about 1500 to about 3,000.

14. The lubricant of claim 3 wherein said long chain hydrocarbon has an $\overline{M}_n$ of from about 1500 to about 5,000.

* * * * *